United States Patent [19]

Grims et al.

[11] Patent Number: 4,807,459

[45] Date of Patent: Feb. 28, 1989

[54] REDRAW APPARATUS FOR A CAN BODY MAKING APPARATUS

[75] Inventors: Conrad M. Grims; Bert Johansson, both of Golden, Colo.

[73] Assignee: Adolph Coors Company, Golden, Colo.

[21] Appl. No.: 69,840

[22] Filed: Jul. 1, 1987

[51] Int. Cl.[4] ..... B21D 22/21

[52] U.S. Cl. ..... 72/347; 72/456; 413/69

[58] Field of Search ..... 72/449, 450, 456, 344, 72/347; 413/69

[56] References Cited

U.S. PATENT DOCUMENTS

| | | | |
|---|---|---|---|
| 2,869,177 | 1/1959 | Jurgeleit | 72/456 |
| 2,924,491 | 2/1960 | Wallgren . | |
| 3,003,411 | 10/1961 | Judd . | |
| 3,168,013 | 2/1965 | Williamson . | |
| 3,495,526 | 2/1970 | Mohler et al. | 72/456 |
| 3,696,657 | 10/1972 | Maytag | 72/456 |
| 3,735,629 | 5/1973 | Paramonoff | 72/349 |
| 3,919,878 | 11/1975 | Groos | 72/456 |
| 3,955,394 | 5/1976 | Kaufman et al. | 72/344 |
| 4,048,841 | 9/1977 | Kent | 72/450 |
| 4,173,138 | 11/1979 | Main et al. . | |
| 4,530,228 | 7/1985 | Snyder et al. . | |
| 4,578,981 | 4/1986 | Nishikawa et al. . | |
| 4,614,104 | 9/1986 | Straw . | |

*Primary Examiner*—W. Donald Bray
*Attorney, Agent, or Firm*—Klaas & Law

[57] ABSTRACT

A redraw apparatus is provided for a can body making apparatus wherein the redraw carriage of the redraw apparatus is mounted for substantially friction-free sliding reciprocating movement over a pair of spaced apart support posts which are fixedly mounted on the housing holding the can forming and ironing dies. Also, a counterbalancing system is provided for applying a force to counterbalance the weight of a portion of structures used to reciprocate the redraw carriage.

14 Claims, 2 Drawing Sheets

REDRAW APPARATUS FOR A CAN BODY MAKING APPARATUS

FIELD OF THE INVENTION

This invention relates generally to a can body making apparatus and more particularly to an improvement in the redraw apparatus for providing and maintaining more accurate alignment of the can blanks with the ram and the tool pack containing the can forming and ironing dies.

BACKGROUND OF THE INVENTION

A can body making apparatus is disclosed in U.S. Pat. No. 3,696,657 issued to J. H. Maytag, which is incorporated herein by reference. The redraw apparatus in this patent comprises a redraw sleeve mounted on a redraw carriage that moves on rollers over carriage way strips, as illustrated in FIG. 12 thereof. Each pair of upper and lower rollers are urged toward each other so as to be in firm contact with the carriage way strip located therebetween. The redraw carriage is reciprocated at rates sufficient to form about two hundred cans a minute. The constant reciprocal movement of the redraw carriage and the tight engagement of the rollers on the carriage way strips result in wear which causes misalignment of the can blanks by the redraw sleeve. It is understood that this misalignment is small, between about 0.005 and 0.010 of an inch, but such misalignment can result in defective cans.

BRIEF DESCRIPTION OF THE INVENTION

This invention provides a redraw apparatus for a can body making apparatus wherein the redraw carriage is slidably mounted on a pair of spaced apart support posts for reciprocal movement thereover, which support posts are fixedly mounted on the housing holding the can forming and ironing dies. The invention also provides counterbalancing means for supporting at least a major portion of the weight of the redraw actuating rod also known as the push rod to substantially eliminate the weight on the carriage sleeve for more efficient operation.

In the preferred embodiment of the invention, a redraw apparatus is provided for a can body making apparatus having means for reciprocating a ram assembly along its longitudinal axis so that it pushes a can blank through can forming and ironing dies to form a can body. A redraw carriage including a redraw sleeve is located between the ram assembly and the can forming and ironing dies and functions to hold a can blank in the proper position against the can forming and ironing dies so that the ram assembly will push the can blank through the can forming and ironing dies to form a can body. The redraw apparatus includes a redraw carriage that is provided with a pair of spaced apart bearings having generally cylindrical inner surfaces. A pair of spaced apart support posts are fixedly mounted on the housing holding the can forming and ironing dies and have generally cylindrical outer surfaces. The redraw sleeve is slidably mounted on the spaced apart support posts for substantially friction free movement thereover. The longitudinal axes of the spaced apart support posts and bearings are parallel to the longitudinal axis of the ram assembly and the redraw sleeve holds the can blank so that the longitudinal axis thereof is aligned with the longitudinal axis of the ram assembly. Reciprocating means are provided for providing reciprocal movement of the redraw carriage over the spaced apart support posts. A counterbalancing means, comprising a plurality of springs mounted in a fixed position and applying a force against a portion of the reciprocating means, removes substantially all of the weight on the redraw carriage to virtually eliminate wear of the bushings and posts.

BRIEF DESCRIPTION OF THE DRAWING

An illustrative and presently preferred embodiment of the invention is shown in the accompanying drawing in which.

DETAILED DESCRIPTION OF THE DRAWING

Figure 1:
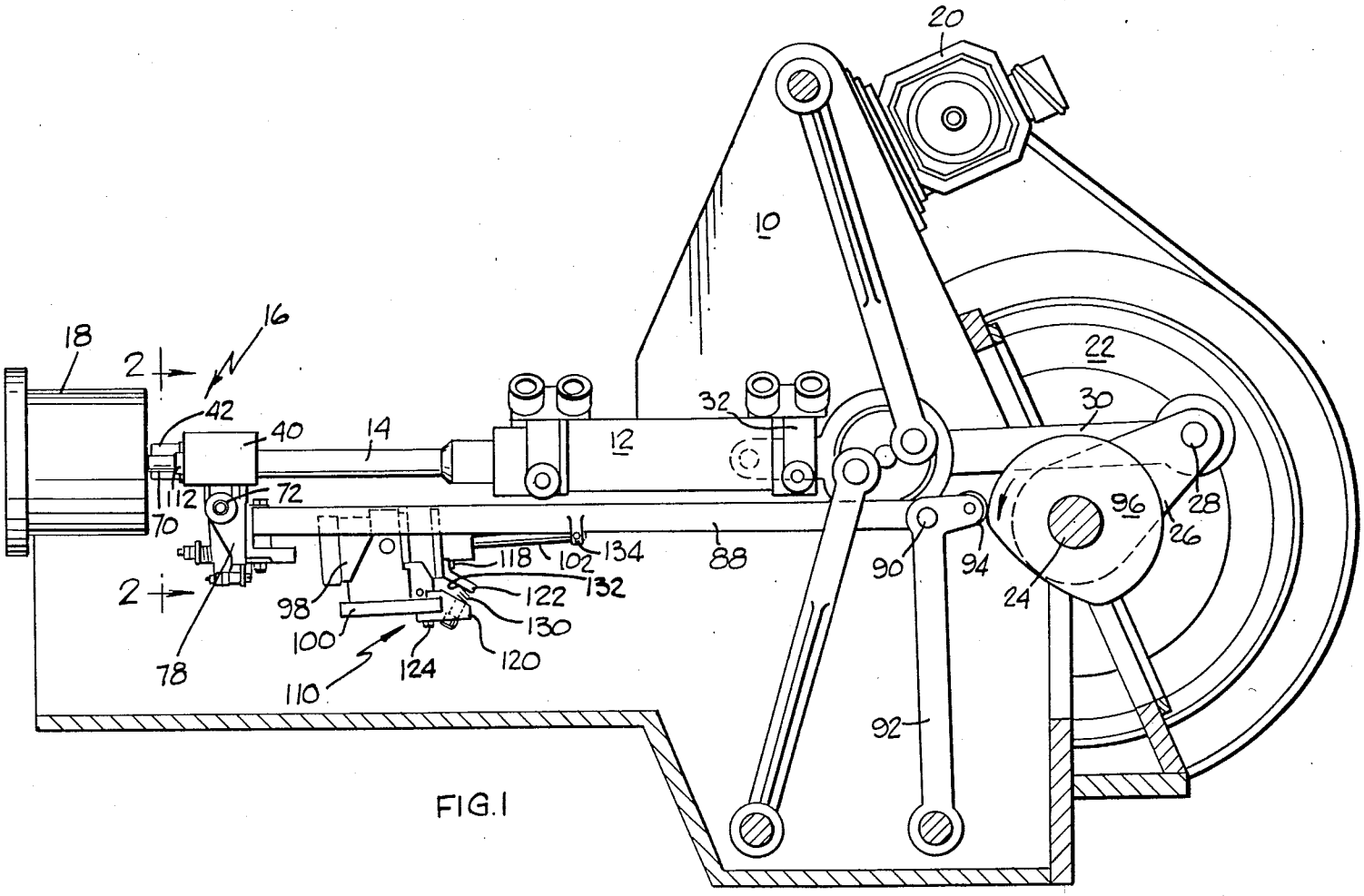
FIG. 1 is a side elevational view similar to FIG. 6 of the Maytag patent.
Figure 6:
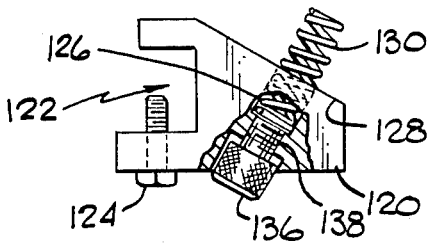
FIG. 6 is a side elevational view of the spring holding means of the counterbalancing means.

The apparatus illustrated in FIG. 1 corresponds to that illustrated in FIG. 6 of the Maytag patent. A frame 10 has a ram carriage 12 mounted thereon for reciprocating movement over a pair of spaced apart opposed way strips (not shown). The ram carriage 12 has a ram 14 mounted thereon so that during the forward stroke, the ram 14 will pass through the redraw apparatus 16 and through the housing 18 containing the can forming and ironing dies similar to those in U.S. Pat. No. 3,735,629 to Paramonoff, which is incorporated herein by reference. The mechanism for reciprocating the ram carriage 12 includes the motor 20, the pulley wheel 22, the crank shafts 24, the crank arms 26, the crank pins 28, the main connecting rod 30 and cross-head members 32, all of which are conventional.

The redraw apparatus 102 of this invention is illustrated in FIGS. 1–4 and comprises a redraw carriage 40 having a conventional redraw sleeve 42. The redraw carriage 40 is provided with a pair of spaced apart longitudinally extending bores 44 and 46 which are located on both sides of bushing 48 mounted in the redraw carriage 40. One end of each bore 44 and 46 is enlarged and bearing means 50 and 52 are fixedly mounted therein. The bearing means 50 and 52 preferably comprise a bronze bushing having a cylindrical inner surface 54. The redraw carriage 40 is also provided with a pair of bores 56 in which are mounted rocker pivots 58 similar to those in the Maytag patent. The redraw carriage 40 also is provided with passageways 60. A rocker arm 62 similar to the one in the Maytag patent has extensions 64 which extend through the passageways 60 and are pivotally mounted on the rocker pivots 58 to provide the force to reciprocate the redraw carriage 40.

A pair of spaced apart support posts 70 and 72 are fixedly mounted on the housing 18 holding the can forming and ironing dies (not shown). Each of the support posts 70 and 72 has a cylindrical outer surface 74 and has a longitudinal axis extending parallel to the longitudinal axis of the ram 14. The redraw carriage 40 is slidably mounted on the support posts 70 and 72 by placing the bearing means 50 and 52 over the support posts 70 and 72. Conventional fittings 76 are provided for supplying lubrication for the bearing means 50 and 52. This slidable mounting of the redraw carriage, as illustrated in FIGS. 1–4, is substantially friction-free and minimizes any wear caused by the reciprocating movement of the redraw carriage so that proper alignment of the redraw sleeve with the ram assembly and the housing holding the can forming and ironing dies is maintained.

Figure 2:
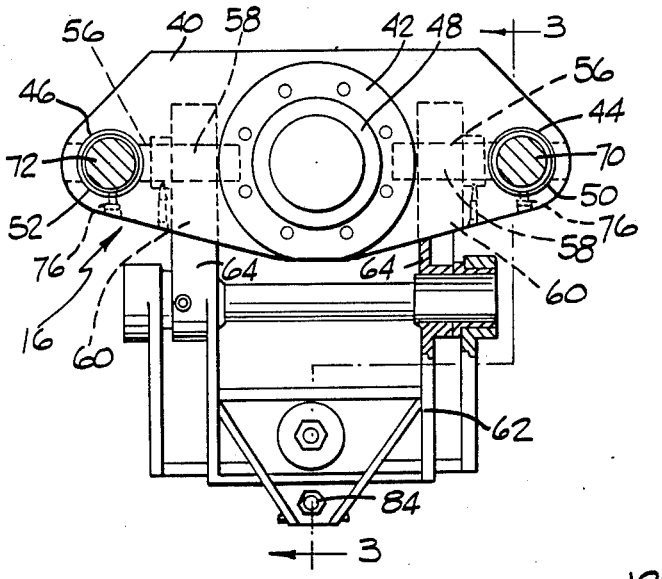
FIG. 2 is an elevational view with parts in section taken on the line 2—2 of FIG. 1.
Figure 5:
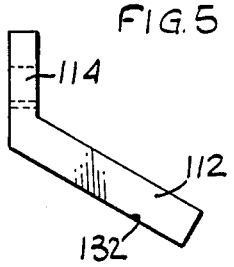
FIG. 5 is a side elevational view of a plate means forming a part of the counterbalancing means.
Figure 3:
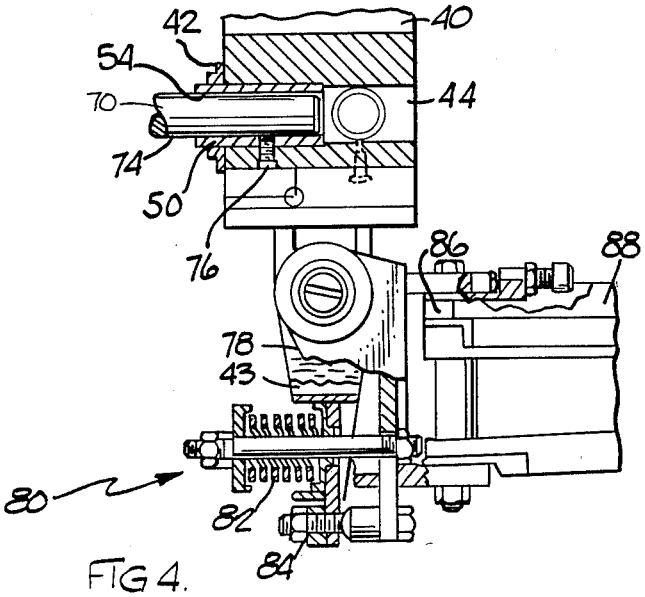
FIG. 3 is an elevational view with parts in section taken along the line 3—3 of FIG. 2.
Figure 7:
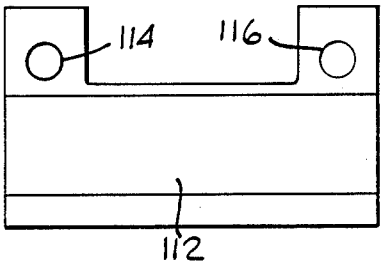
FIG. 7 is a front elevational view of FIG. 5.
Figure 4:
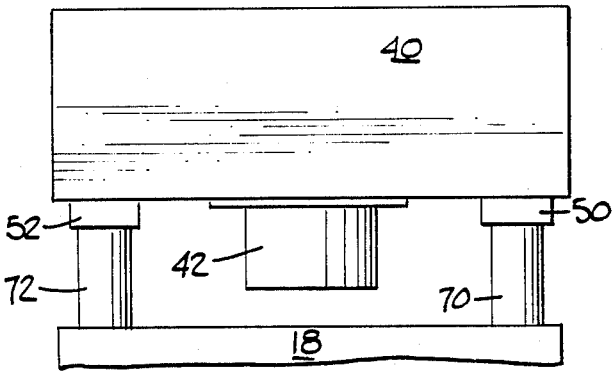
FIG. 4 is a top plan view of a portion of FIG. 2.
Figure 8:
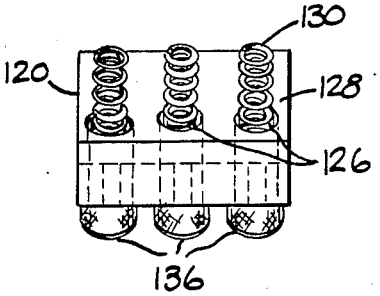
FIG. 8 is a front elevational view of FIG. 6.

The redraw carriage 40 is reciprocated by conventional mechanism as illustrated in FIGS. 1–3. The rocker arm 62 is attached to a shoe 78 which supports the conventional movement arresting means 80 including the spring 82 and adjustable stop screw 84. The shoe 78 is attached to the end 86 of the actuating rod 88 and the end 90 of the actuating rod 88 is pivotally connected to the cam follower lever 92 having a cam follower 94 which is urged against a cam 96 rotated by the wheel 22. An air cylinder 98 is mounted on a fixed support 100 with the free end of its piston rod 102 pivotally connected to the actuating rod 88 at approximately the mid-point thereof. The air cylinder 98 exerts a constant force on the actuating rod 88 through the piston rod 102 to maintain the cam follower 94 in contact with the cam 96 to provide the reciprocating movement to the redraw carriage 40.

A counterbalancing means 110, illustrated in FIGS. 1 and 5–8, is provided for applying a force on the redraw actuating bar 88 so as to substantially eliminate any weight on the redraw carriage 40. The counterbalancing means 110 comprises an angularly shaped member 112 having passageways 114 and 116 so that it may be secured by headed bolts 118 to the housing of the air cylinder 98. A support member 120 having a U-shaped opening 122 is positioned on the support 100 and secured thereto by a set screw 124. A plurality of holes 126 are formed in the support member 120 and extend partially therethrough and have openings in the upper surface 128 thereof. A coiled spring 130 is located in each hole. As illustrated in FIG. 1, the support member 120 is located relative to the member 112 so that the coiled springs 130 are in contact with a generally planar bottom surface 132 on the member 112. Pivot means 134 are provided for pivotally connecting the end of the piston rod 102 to the redraw actuating bar 88. This pivot means 134 is connected to the redraw actuating bar 88 at a generally central location. The coiled springs 130 function to provide a force on the member 112 so as to counterbalance the weight of the redraw actuating bar 88 and its associated structures so that there is substantially no weight placed on the redraw carriage 40. Set screws 136 are threadedly mounted in threaded bores 138 in the support member 120 so that the ends thereof are in contact with the coiled springs 130 so that the amount of force being applied by the coiled springs 130 ma be adjusted. This counterbalancing means 110 virtually eliminates any wear of the bushing means 50 and 52 and the support posts 70 and 72 so that proper alignment of the redraw sleeve with the ram assembly and the housing holding the can forming and ironing dies is maintained.

The redraw carriage 40 and the redraw sleeve 42 are reciprocated over the support posts 70 and 72 to position a can blank (not shown) to be contacted by the ram 14 and be pushed through the can forming and ironing dies in the housing 18 to form a can body.

While an illustrative and presently preferred embodiment of the invention has been described in detail herein, it is to be understood that the inventive concepts ma be otherwise variously embodied and employed and that the appended claims are intended to be construed to include such variations except insofar as limited by the prior art.

What is claimed is:

1. A can body making apparatus comprising means for reciprocating a ram assembly along its longitudinal axis, a housing holding the can forming and ironing dies and a reciprocating redraw apparatus which functions to position a can blank before the can forming and ironing dies so that the ram assembly pushes the can blank through the can forming and ironing dies wherein the redraw apparatus comprises:

housing means mounted in a fixed location for holding can forming and ironing dies;

a ram assembly;

ram reciprocation means for reciprocating said ram assembly;

at least a pair of spaced apart support posts fixedly mounted on said housing means;

said pair of spaced apart support posts projecting out of said housing means in a direction toward said ram reciprocation means;

a redraw carriage having at least a pair of spaced apart bearing means fixedly mounted therein;

said pair of spaced apart bearing means being slidably mounted on said pair of spaced apart support posts to provide substantially friction-free movement of said redraw carriage; and redraw reciprocation means for reciprocating said redraw carriage.

2. The invention as in claim 1 wherein:

each of said pair of spaced apart, support posts has a substantially cylindrical outer surface; and each of said pair of spaced apart bearing means has a substantially cylindrical inner surface.

3. The invention as in claim 2 wherein:

each of said pair of spaced apart, support posts has a longitudinal axis parallel to said longitudinal axis of said reciprocating ram assembly; and each of said pair of spaced apart bearing means has a longitudinal axis parallel to said longitudinai axis of said reciprocating ram assembly.

4. The invention as in claim 3 wherein each of said pair of spaced apart bearing means comprises:

a longitudinally extending bore means in said redraw mechanism; and a bushing fixedly mounted in said bore means.

5. The invention as in claim 1 wherein said redraw reciprocation means comprises:

an elongated redraw actuating bar;

connecting means for connecting one end of said redraw actuating bar to said redraw carriage;

cam follower lever means connected to the other end of said redraw actuating bar;

a cam follower mounted on said cam follower lever means;

rotatable cam means mounted for rotation at a fixed location;

rotation means for rotating said rotatable cam; and force applying means for applying a force to said redraw actuating bar to urge said cam follower against said cam to provide said reciprocating movement to said redraw carriage.

6. A can body making apparatus comprising means for reciprocating a ram assembly along its longitudinal axis, a housing holding the can forming and ironing dies and a reciprocating redraw apparatus which functions to position a can blank before the can forming and ironing dies so that the ram assembly pushes the can blank through the can forming and ironing dies wherein the redraw apparatus comprises:

housing means mounted in a fixed location for holding can forming and ironing dies;

a ram assembly;

ram reciprocation means for reciprocating said ram assembly;

at least a pair of spaced apart support posts fixedly mounted on said housing means;

said pair of spaced apart support posts projecting out of said housing means in a direction toward said ram reciprocation means;

a redraw carriage having at least a pair of spaced apart bearing means fixedly mounted therein;

said pair of spaced apart bearing means being slidably mounted on said pair of spaced apart support posts to provide substantially friction-free movement of said redraw carriage;

redraw reciprocation means for reciprocating said redraw carriage comprising:

an elongated redraw actuating bar;

connecting means for connecting one end of said redraw actuating bar to said redraw carriage;

cam follower lever means connected to the other end of said redraw actuating bar;

a cam follower mounted on said cam follower lever means;

rotatable cam means mounted for rotation at a fixed location;

rotation means for rotating said rotatable cam;

force applying means for applying a force to said redraw actuating bar to urge said cam follower against said cam to provide said reciprocating movement to said redraw carriage; and counterbalancing means for applying a force to said redraw actuating bar to counterbalance the weight thereof.

7. The invention as in claim 6 wherein said force applying means comprises:

an air cylinder mounted at a fixed location;

a piston rod extending outwardly from said air cylinder and urged thereby in a direction toward said cam follower means; and connecting means for pivotally connecting said piston rod to said redraw actuating bar.

8. The invention as in claim 7 wherein said counterbalancing means comprises:

spring means mounted on a fixed support and applying a force on said air cylinder in a direction to counterbalance the weight of said redraw actuating bar.

9. The invention as in claim 7 wherein said counterbalancing means comprises:

an angular shaped member secured to said aircylinder and having a generally planar bottom surface;

a spring means support member mounted in a fixed position;

a plurality of spring means;

a plurality of spring support means in said spring support member, each of said support means supporting a spring means; and said spring support means mounted so that said spring means are in contact with said generally planar bottom surface and exert a force thereon to counterbalance the weight of said actuating rod.

10. The invention as in claim 9 and further comprising:

adjusting means for varying the location of said spring support means so as to vary the force being applied to said generally planar bottom surface.

11. The invention as in claim 10 wherein said spring support means and said adjusting means comprises:

a plurality of holes extending partially through said spring means support member;

a plurality of threaded bores in said spring means support member; and a plurality of threaded set screws in said threaded bores and having ends in contact with said spring means.

12. The invention as in claim 11 wherein:

each of said pair of spaced apart, support posts has a substantially cylindrical outer surface; and each of said pair of spaced apart bearing means has a substantially cylindrical inner surface.

13. The invention as in claim 12 wherein:

each of said pair of spaced apart, support posts has a longitudinal axis parallel to said longitudinal axis of said reciprocating ram assembly; and each of said pair of spaced apart bearing means has a longitudinal axis parallel to said longitudinal axis of said reciprocating ram assembly.

14. The invention as in claim 13 wherein each of said pair of spaced apart bearing means comprises:

a longitudinally extending bore means in said redraw carriage; and a bushing fixedly mounted in said bore means.

* * * * *